US008186730B2

(12) United States Patent
Berghahn et al.

(10) Patent No.: US 8,186,730 B2
(45) Date of Patent: May 29, 2012

(54) LATCH FOR VEHICLES

(75) Inventors: Jörg Berghahn, Gelsenkirchen (DE); Dirk Ruppach, Bochum (DE); Hans-Günter Kaiser, Wuppertal (DE); Rolf Kamps, Wuppertal (DE); Jürgen Moczygemba, Reutlingen (DE); Eckart Schuler, Sindelfingen (DE)

(73) Assignee: Huf Hulsbeck & Furst GmbH & Co. KG, Velbert (DE)

( * ) Notice: Subject to any disclaimer, the term of this patent is extended or adjusted under 35 U.S.C. 154(b) by 411 days.

(21) Appl. No.: 12/312,379

(22) PCT Filed: Oct. 26, 2007

(86) PCT No.: PCT/EP2007/009293

§ 371 (c)(1),
(2), (4) Date: May 7, 2009

(87) PCT Pub. No.: WO2008/055595

PCT Pub. Date: May 15, 2008

(65) Prior Publication Data

US 2010/0000271 A1 Jan. 7, 2010

(30) Foreign Application Priority Data

Nov. 8, 2006 (DE) ..... 10 2006 052 626

(51) Int. Cl.
*E05C 3/06* (2006.01)

(52) U.S. Cl. ..... 292/201; 292/216

(58) Field of Classification Search ..... 292/194, 292/201, 202, 216, DIG. 23, DIG. 42; 49/280
See application file for complete search history.

(56) References Cited

U.S. PATENT DOCUMENTS

| | | | | | |
|---|---|---|---|---|---|
| 2,541,723 | A * | 2/1951 | Shaw et al. | 70/470 |
| 3,547,476 | A * | 12/1970 | Nockemann | 292/216 |
| 4,395,064 | A * | 7/1983 | Bellot et al. | 292/201 |
| 4,756,564 | A * | 7/1988 | Ikeda | 292/216 |
| 5,000,495 | A * | 3/1991 | Wolfgang et al. | 292/216 |
| 5,236,234 | A * | 8/1993 | Norman | 292/201 |
| 5,273,324 | A * | 12/1993 | Kobayashi | 292/201 |
| 5,487,290 | A * | 1/1996 | Miller et al. | 70/303 A |
| 5,673,578 | A * | 10/1997 | Roos | 70/264 |
| 6,546,671 | B2 * | 4/2003 | Mitchell et al. | 49/185 |
| 2005/0167990 | A1 * | 8/2005 | Orzech et al. | 292/201 |

* cited by examiner

*Primary Examiner* — Thomas Beach
*Assistant Examiner* — Nathan Cumar
(74) *Attorney, Agent, or Firm* — Lucas & Mercanti, LLP; Klaus P. Stoffel

(57) ABSTRACT

The invention relates to a latch that comprises a lock and a closing part (10). Said lock comprises a catch (15), a click (20) equipped with an adjusting arm (21) and a motorised opening aid (30). Said catch (15) comprises a receiving element for the closing part (10) and at least one stop notch (17) for engaging the click (20). The opening aid (30) is equipped with an eccentric (40) that is driven by a motor, whereby the eccentric curve interacts with a lateral adjusting surface of the adjusting arm (21) and ensures that the clink (20) is displaced in a motorised manner from its locked position in the stop notch (17) into an elevated position. In order to prevent problems in the latch, an end segment (42) of the eccentric (40) and/or the adjusting arm (21) of the clink (20) is elastic. When in the elevated position, the clink (20) is on a fixed stop (18), performing an elastic deformation (59) when passing the eccentric end segment (42) on the adjusting arm (21) of the clink (20), until an end-sided shoulder of the eccentric (40) catches behind a counter shoulder on the adjusting arm (21). After catching, the eccentric shoulder is supported on the clink counter shoulder and prevents the eccentric (40) from reversing.

12 Claims, 7 Drawing Sheets

LATCH FOR VEHICLES

The invention concerns a lock mechanism of the type specified in the introductory clause of Claim 1. The lock that is part of the lock mechanism comprises a catch, a latch with an actuating arm, and a motorized opening aid. The opening aid has a driven eccentric, whose eccentric curve cooperates with a lateral actuating surface on the actuating arm in order to move the latch by means of a motor out of its locked position in the catch and into a lifted position. The catch is then free to release the closing part that it is grasping.

DE 102 06 813 A1 discloses a well-known lock mechanism of this type, in which the eccentric is dimensionally stable over the entire length of its eccentric curve. If the latch is in its lifted position, and the catch is released, the stress can cause a movement in the reverse direction of the eccentric, where an end segment of the eccentric, which has the maximum radii relative to the axis of the eccentric, moves back in front of the actuating arm of the latch. The latch is then fixed in its lifted position and cannot engage the catch again when the catch is back in its lock-in position. The lock mechanism cannot then be brought into its locked position; it is not able to hold the grasped closing part in the lock.

To prevent this, the motor contacts must be short-circuited after the current has been shut off. However, this requires a relay, which takes up a great deal of space and increases costs. A relay of this type requires not only the installation and connection of electric lines but also a control unit that activates the relay.

The objective of the invention is to develop a reliable and low-cost lock mechanism of the type specified in the introductory clause of Claim 1, which prevents malfunctions of the lock. In accordance with the invention, this objective is achieved by the features specified in the characterizing clause of Claim 1, which have the following special significance.

The special feature of the invention is that an end segment of the eccentric, where the eccentric curve has the maximum radii relative to the axis of the eccentric, is designed to be elastically yielding in the radial direction. Additionally or alternatively, the actuating arm of the latch could also be elastically yielding in the radial direction. In the fully lifted position of the latch, elastic snap-in then occurs, because the latch is then supported on a stationary stop in the lock and cannot be swung further away. When the end segment of the eccentric passes by the actuating arm of the latch, elastic deformation takes place until finally a shoulder of the eccentric that defines the maximum end radius of the end segment snaps into place behind an opposing shoulder on the actuating arm. In the fully lifted position of the latch, the radial distance between the latch actuating arm and the axis of the eccentric is significantly less than the maximum end radius of the eccentric curve. A relay that occupies a great deal of space for short-circuiting the motor contacts after the current has been shut off is not necessary in the invention. This component can basically be eliminated in the invention. The aforementioned oversize of the radius of the end segment prevents the aforementioned malfunction of the lock of the invention. Although reverse rotation of the eccentric can occur in the invention without a relay after the motor stops, this reverse rotation can be reliably limited by supporting the shoulder of the eccentric with the latch opposing shoulder. Uncontrolled reverse rotation of the eccentric is then reliably prevented.

Other features and advantages of the invention are described in the dependent claims and the description which follows and are illustrated in the drawings. A specific embodiment of the invention is explained below with reference to the drawings, which show the most important components of the lock mechanism and show different positions of the lock components.

FIG. 1, in a top view of the opened lock with the closing part shown in cross section, shows a locked position of the lock mechanism, where the lock is shown with a section of a trunk lid and the associated closing part is shown with a section of the vehicle body.

FIG. 2, in the same view but leaving out the indicated trunk lid and automobile body of FIG. 1, which also applies to the remaining drawings, shows an initial phase in the opening of the lock mechanism.

Figure 1:
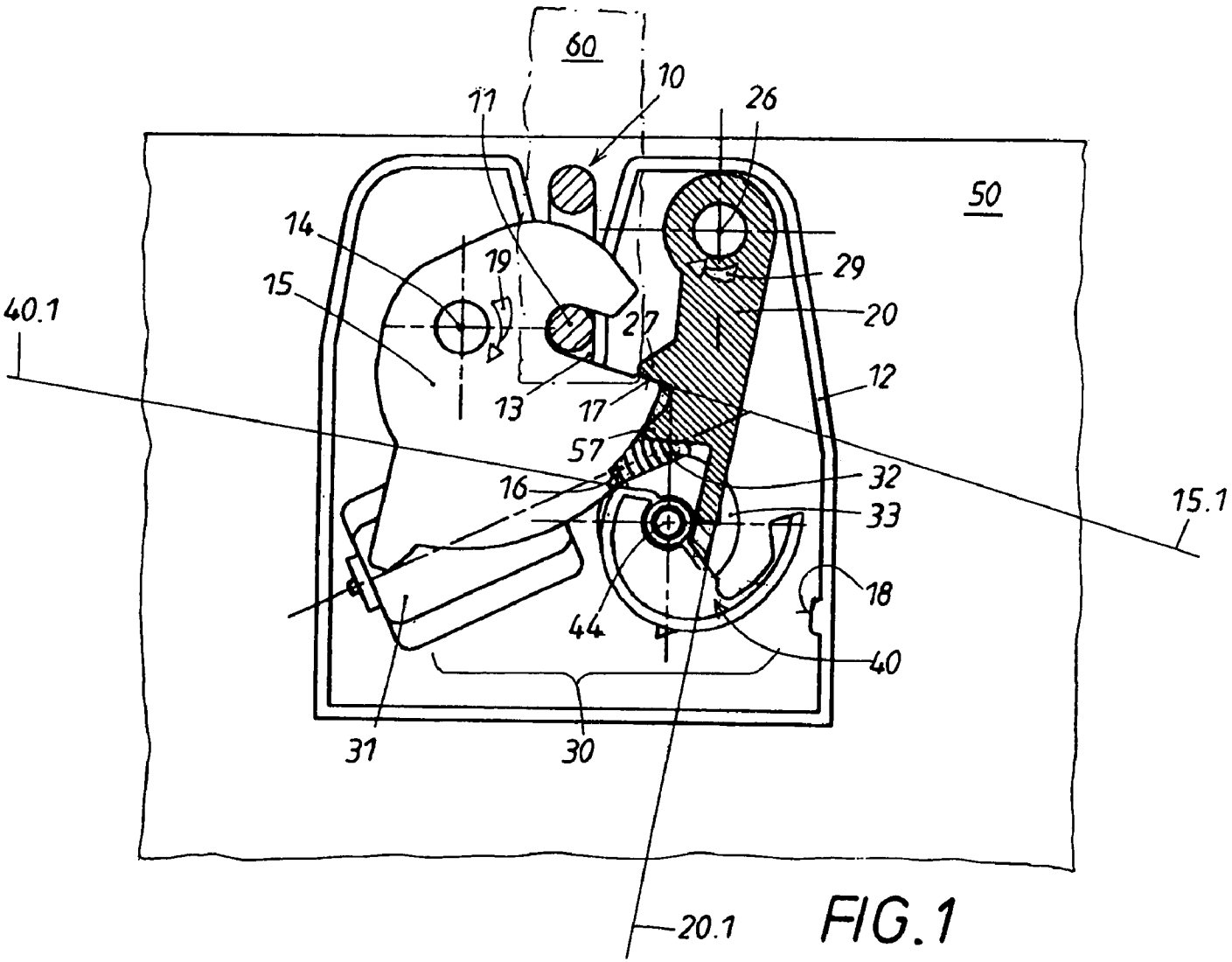

The lock mechanism of the invention consists of a lock with a lock housing 12 and a closing part 10. The lock housing 12 is mounted on a movable trunk lid 50 of a motor vehicle. FIG. 1 shows only a section of the trunk lid 50. The closing part 10 consists of a U-shaped closing bow, whose two legs are seated on a stationary body 60 of the motor vehicle. FIG. 1 shows only a section of the vehicle body (dot-dash line). One of the legs 11 of the U-shaped closing bow 10 is able to engage one of the lock components.

The inside of the lock contains numerous components, of which only the most important are shown in the drawings. These important parts include, first of all, the aforementioned catch 15, which is rotatably supported on an axis 14 and is under the effect of spring tension, as illustrated by the arrow 19. The catch 15 has a slot-like recess 13 for receiving the front leg 11 of the U-shaped closing bow 10. In addition, in the present case, the catch 15 has two stop notches 16, 17, namely a prelocking stop notch 16 and a main stop notch 17.

Figure 6:
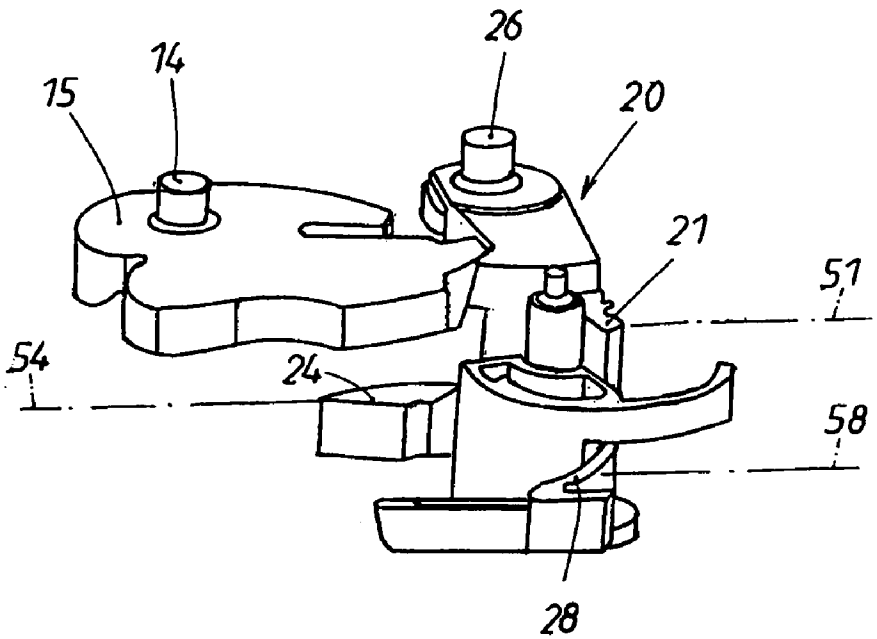
FIG. 6 shows a perspective side view of the lock components in the locked position of FIG. 1.
Figure 8:
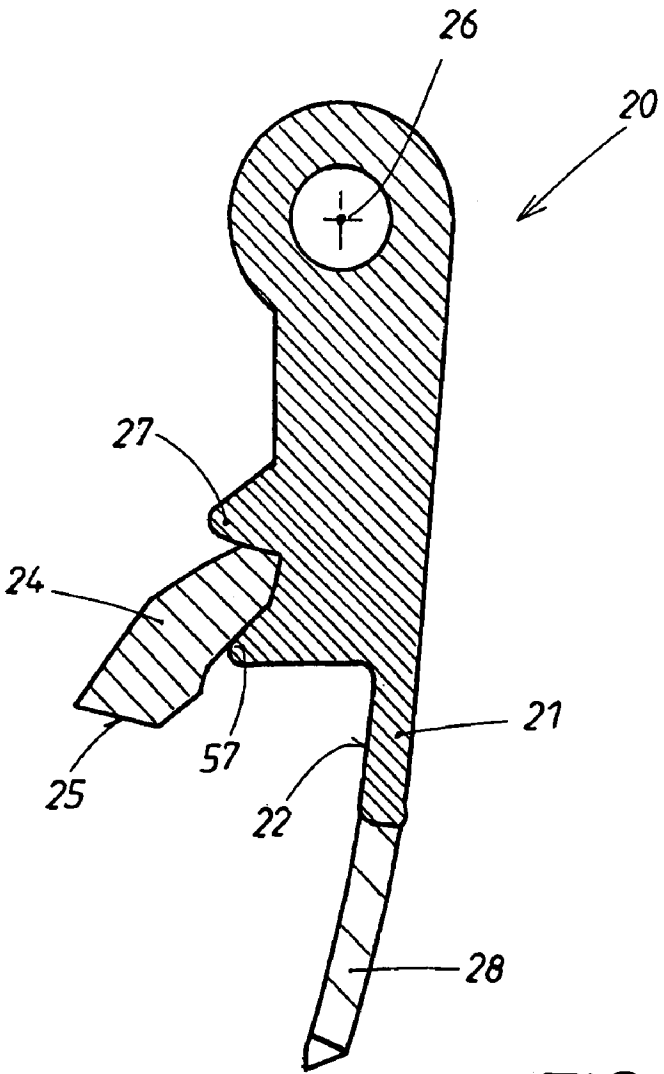
FIG. 8 shows an enlarged view of a second important component of the lock, namely, a latch with three arms that are located at different heights, as FIG. 6 shows and as is illustrated in FIG. 8 with three different types of shading.

Furthermore, a latch 20 is supported on an axis of rotation 26 in the housing 12 and is under the effect of spring tension, as illustrated by a force arrow 29. The appearance of the latch 20 is shown especially well by FIGS. 6 and 8. The latch 21 has three arms 21, 24, and 28, which not only have different arm lengths and extend in different directions with respect to the axis of rotation 26 but also lie at three different height levels 51, 54, 58, as indicated by the dot-dash lines in FIG. 6. The different height levels of these arms 21, 24, 28 is highlighted in the drawings by different types of shading.

The three arms have three different functions, which are already expressed in their designations and are described in greater detail below. The first arm 21 is an "actuating arm", which is located in the uppermost level 51 of FIG. 6. The second arm 24 is a "blocking arm", which is located in a middle level 54. The third arm 28 is a "supporting arm" and is located in the lowermost level 58.

Finally, the latch 20 has two projecting catches 27, 57, the first of which 27 is a "locking catch," because in the locked position of the lock components shown in FIG. 1, it grips behind the main stop notch 17 of the catch 15. The other projecting catch 57, on the other hand, in the locked position of FIG. 1, is supported on the peripheral contour of the closing catch 15 that lies between the main stop notch 17 and the prelocking stop notch 16. Due to its supporting action, the second projecting catch 57 will be referred to as the "supporting catch." The supporting catch 57 depth of engagement of the locking catch 27 on the main stop notch 17.

Another component of the lock is a motorized opening aid 30, which is located in the lock housing 12. It consists of a motor 31 that can be turned on and off by an electric control unit, a worm 32 that can be seen in FIG. 1, and a worm gear 33 that meshes with the worm 32. A segmented eccentric 40 is nonrotatably connected with the worm gear 33 by an eccentric axis 44. In accordance with the invention, the eccentric has a special design, which can best be explained with reference to the enlarged view shown in FIG. 7.

The eccentric 40 has an eccentric curve 46, which starts with a smallest radius 61 relative to the axis 44 of the eccentric and expands to an intermediate radius 62 and finally a maximum end radius 63. The eccentric curve 46 can be divided into two segments 41, 42, namely, a main segment 41 and an end segment 42, which has a special design in accordance with the invention. Apart from the reinforced peripheral flange 36 for the eccentric curve 46 and radial ribs, the eccentric 40 consists of a disk 47, which is provided with a slot 38 in the area of the end segment 42, which weakens the disk in this end segment 42. Only a small remnant 39 of the disk remains in the reinforced peripheral area 36 of the eccentric 40, but this disk remnant 39 widens again towards the free end face 49, where it forms a relatively wide shoulder 43 of the eccentric 40.

Figure 7:
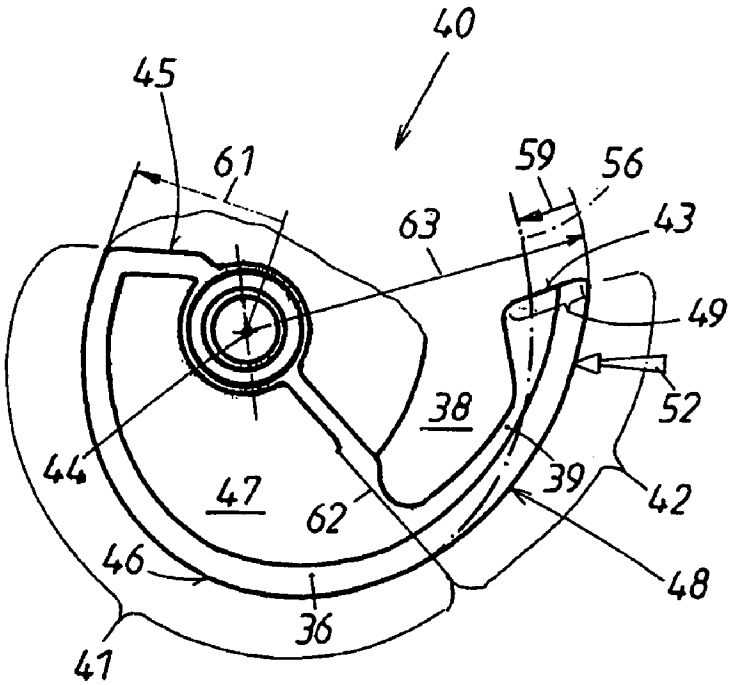
FIG. 7 shows an enlarged top view of a first important component of the lock, namely, an eccentric that is part of the opening aid of the invention.

The eccentric 40 is constructed as a single piece and consists of plastic material. The weakening caused by the slot 38 renders the disk remnant 39 flexurally elastic. If a radial force is exerted on the end segment 42 in the direction of the force arrow 52, the radial deformation illustrated by the bending arrow 59 in FIG. 7 is produced. When this occurs, the maximum radius 63 can immediately and temporarily decrease to the intermediate radius 62, as indicated by a dot-dash line 56 in FIG. 7. As the dot-dash bending line 56 of the eccentric curve 46 under stress shows, the end segment 42 acts as a "spring arm" of the eccentric 40. This spring arm is labeled as 48 in FIG. 7.

FIG. 1 shows a closed position of the trunk lid 50, on which the lock housing 12 is mounted. At this point, the rotary catch 15 is engaged with one of the legs 11 of the closing part 10 and is supported with its main stop notch 17 on the locking catch 27 of the latch 20. The catch 15 is then in its main lock-in position 15.1, as indicated by the auxiliary line 15.1, while the latch 20 is in its locked position 20.1, as indicated by the auxiliary line 20.1. In this connection, the motor 31 is initially at rest, so that the eccentric 40 occupies its initial position, which is marked with the auxiliary line 40.1. As mentioned above, the lock mechanism is in its locked position.

Figure 2:
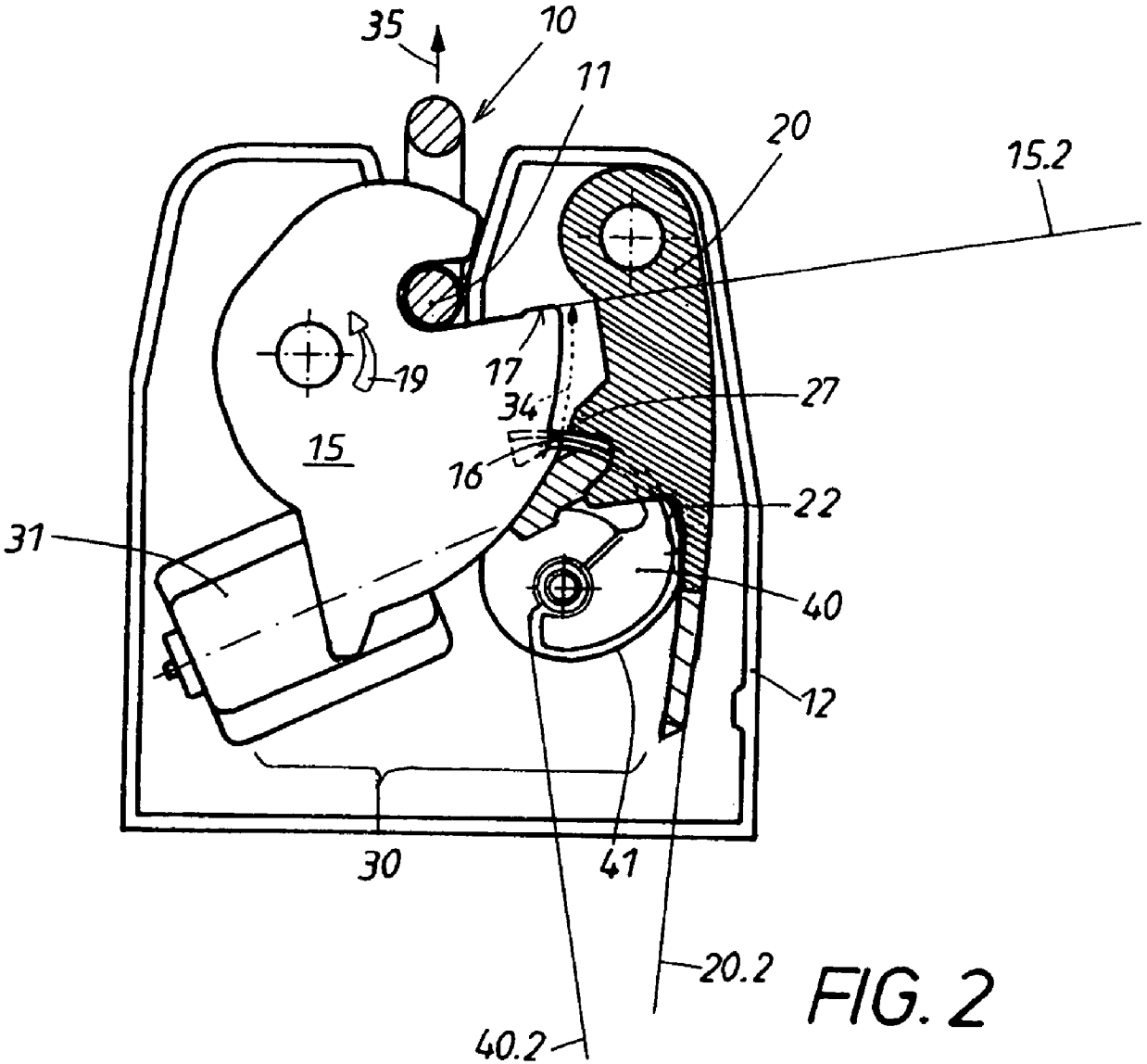

The lock mechanism is normally unlocked by means of the motorized opening aid 30. The authorized person expresses his desire to open the trunk lid 50 by making suitable contact with an electric control unit (not shown) by means that are already well known, and the electric control unit then starts the motor 31, which then sets the eccentric 40 in motion by means of gears 32, 33. This causes the eccentric 40 to enter a first intermediate position 40.2, which is shown in FIG. 2. During this movement, the main segment 41 of the eccentric 40 moves against an actuating surface 22 of the actuating arm 21, thereby pushing the latch 20 into an initial phase, which is indicated by the auxiliary line 20.2, in which the locking catch 27 of the latch 20 has released not only the main stop notch 17 but also the prelocking stop notch 16 of the catch 15. As is evident from the dotted motional arrow 34 in FIG. 2, the prelocking stop notch 16 can also move freely past the locking catch 27. As a result, the catch 15 is unengaged and can move into an intermediate phase marked by the auxiliary line 15.2 when the catch moves upward due to the force acting on it, as indicated by the force arrow 19. In the process, the engaged leg 11 of the closing part 10 has been moved upward a small distance, so that the closing part 10 has been moved a small distance out of the lock housing 12, as indicated by the arrow 35. In this first intermediate position 40.2, the dimensionally stable main segment 41 of the eccentric 40 is still in contact with the actuating surface 22 of the latch 20.

Figure 3:
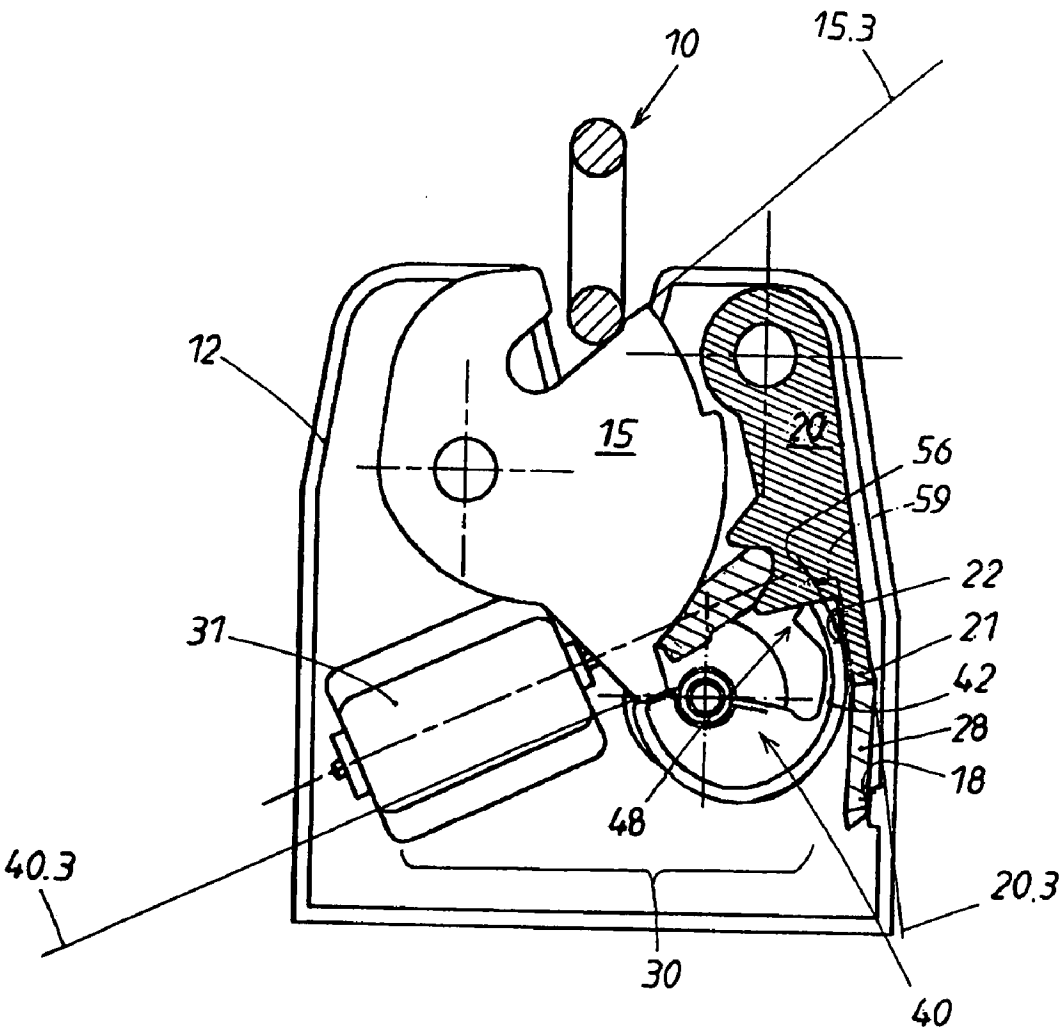
FIG. 3 shows a subsequent intermediate phase in the opening of the lock mechanism.

The actively operating motor 31 at first continues to run until the second intermediate position 40.3 of the eccentric 40 has been reached (FIG. 3). The elastic end segment 42 of the eccentric 40 then interacts with the actuating surface 22 of the actuating arm 21 of the latch 20. This results in the bending 56 of the spring arm 48 formed by the end segment 42, as was explained earlier in connection with FIG. 7. The extent of bending is shown by the arrow 59, which was explained earlier in connection with FIG. 7 and is also shown in FIG. 3. The supporting arm 28 already comes to rest on a stationary stop 18 in the lock housing 12 during the transition from FIG. 2 to FIG. 3. As FIG. 3 shows, the latch 20 is then located in its fully lifted position, as illustrated by the auxiliary line 20.3. The catch 15 has already released the closing part 10 in FIG. 3 and therefore is in the fully open position marked by the auxiliary line 15.3. However, the motor 31 continues to run until the conditions shown in FIG. 4 appear.

Figure 4:
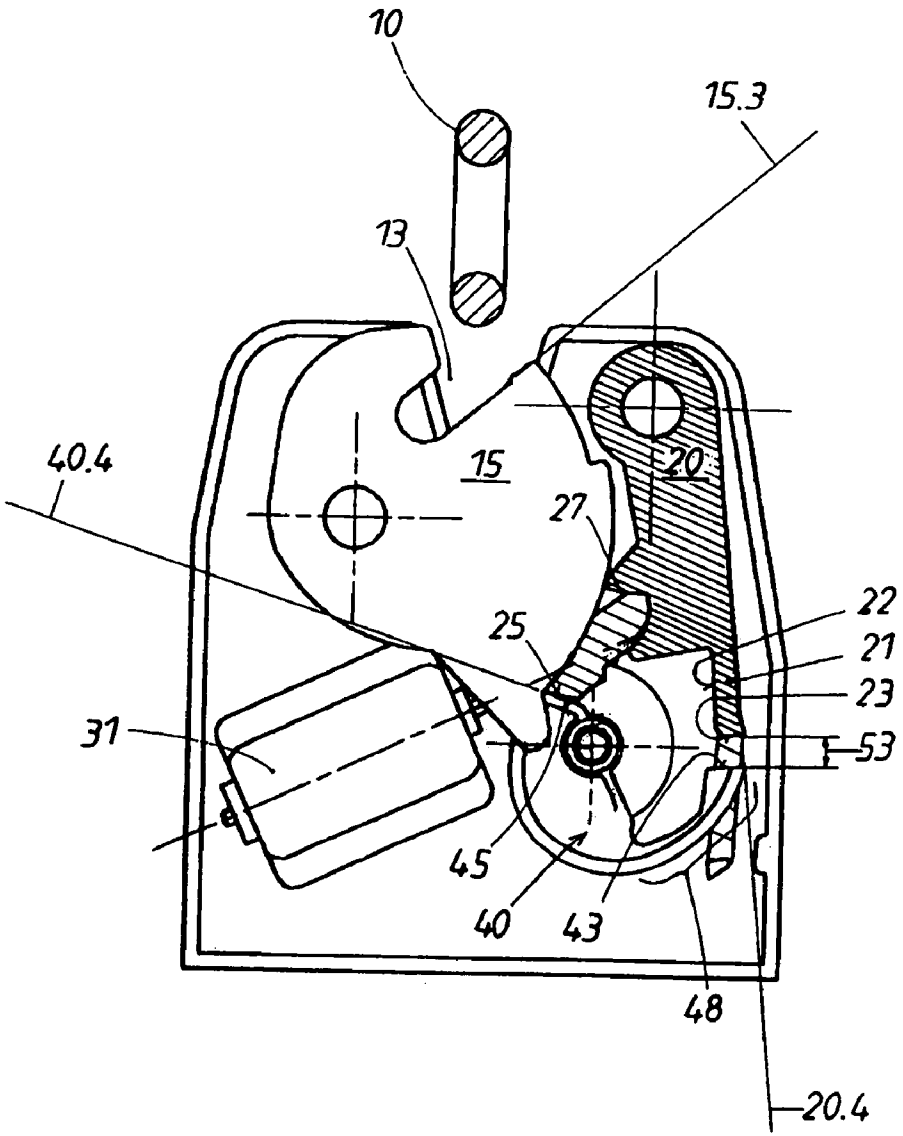
FIG. 4 shows a special blocking position of the lock mechanism in the final phase of the opening operation.

In FIG. 4, the forward impact surface 45 of the eccentric 40 strikes an opposing impact surface 25 located on the blocking arm 24 of the latch 20. This stops the movement of the components of the opening aid 30. An expensive relay that takes up a large amount of space for short-circuiting the motor 31 is no longer needed. The stopping of the motor 31 is recorded by the electric control unit, e.g., by an abrupt rise in the electric current, and the power supply to the motor 31 is shut off.

In FIG. 4, as the auxiliary line 40.4 illustrates, the eccentric 40 is in an overstroke position, in which the end of the spring arm 48 not only has released the actuating surface 22 of the eccentric actuating arm 21 but also is now located some distance 53 from it. FIG. 4 shows that there is also a gap 53 between a shoulder 43 at the end face of the eccentric 40, which has already been described in connection with FIG. 7, and an opposing shoulder 23 of the actuating arm 21 of the latch 20. The catch 15 continues to be in its open position, which is already shown in FIG. 3. In the meantime, the closing part 10 has moved still farther away from the catch recess 13. In the overstroke position of FIG. 4, there is already a gap, which subsequently opens further, between the trunk lid 50 and the automobile body 60, sections of which are shown in FIG. 1 but are omitted from FIGS. 2 to 8.

As the details of FIG. 7 show, the impact surface 45 is located at the beginning of the dimensionally stable main segment 41 of the eccentric 40. This impact surface 45 runs approximately perpendicularly to the eccentric curve 46 at this point. One can also speak of a radial course of the impact surface 45 with respect to the axis 44 of the eccentric. The associated opposing impact surface 25 of the blocking arm 24 of the latch 20 is located on the free end face of the blocking arm 24.

Figure 5:
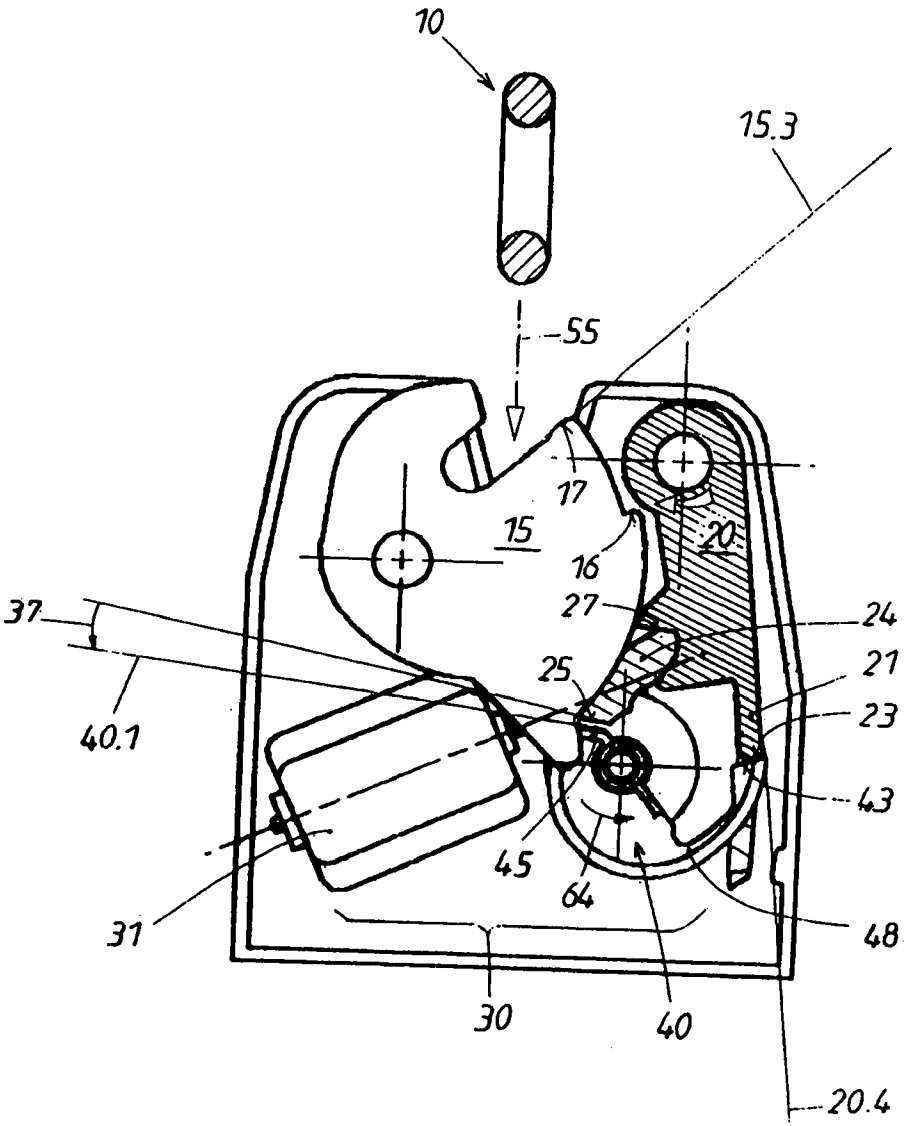
FIG. 5 shows the fully open position of the lock mechanism, in which the trunk lid is opened.

As the transition of the blocking position from FIG. 4 to FIG. 5 illustrates, the lock components can experience springback. As a result of this springback, the eccentric 40 rotates back in the direction of the arrow 64 shown in FIG. 5. However, this reverse rotation 37 is limited, because the eccentric shoulder 43 of the end face of the spring arm 48 mentioned earlier in connection with FIG. 7 strikes the aforementioned opposing shoulder 23 of the actuating arm 21 of the latch 20. This results in a full-surface impact between the shoulder 43 and the opposing shoulder 23, which cannot produce the previously described bending 59 of the spring arm 48. The elasticity of the spring arm 48 is ineffective in connection with this full-surface impact. As has already been explained in connection with FIG. 7, the impact surface 45 of the eccentric 40 has a radial expansion at the end face 49 of the spring arm 48, which ensures the full-surface impact shown in FIG. 5. The end radius 63 is much larger than the intermediate radius 62 at the transition between the main segment 41 and the end segment 42 of the eccentric 40, as was described earlier in connection with FIG. 7. At the opposite end of the eccentric 40, a gap 37 can form between the impact surface 45 and the opposing impact surface 25.

Due to these dimensional differences and position of the lock components relative to one another, it is basically ruled out that the end of the spring arm 48 could come in front of the actuating surface 22 of the actuating arm 21 of the latch 20 to keep the actuating surface 22 pushed back in a fully lifted position 20.3 according to FIG. 3. Specifically, if in the open position of the lock mechanism, an emergency actuation (not shown) is carried out, then without the measures of the invention described above, an eccentric 40 could settle in front of the actuating surface 22 of the latch. The emergency actuation is normally used to lift the latch when the electric drive of the opening aid 30 is defective. In a case of this sort, which does not concern the invention, the latch would then be prevented from falling into the prelocking stop notch 16 or the main stop notch 17.

However, the latter is prevented in the invention, as has already been noted in connection with FIG. 5. In FIG. 5, the eccentric 40 is back in the initial position 40.1 it occupied in FIG. 1. The catch 15 is still in the open position shown in FIGS. 3 and 4, as indicated by the auxiliary line 15.3. Due to its spring tension 29, the latch 20 has moved against the peripheral surface of the catch 15, where it is supported with its locking catch 27. In the meantime, the closing part 10 has moved farther relative to the catch 15, because the trunk lid (not shown in FIG. 5) has moved farther in the direction of its fully opened position.

The auxiliary line 20.4 marked in FIG. 5 is a "readiness position" of the latch 20. Due to the aforementioned contact of the locking catch 27 of the latch 20 on the periphery of the catch 15, the latch 20 is ready, when the trunk lid is later closed, to fall reliably into the prelocking stop notch 16 or the main stop notch 17 of the catch 15. This closing movement takes place relative to the closing part 10 in the direction indicated by the dot-dash arrow 64. Additionally or alternatively, this readiness position 20.4 of the latch 20 can provide for the previously described full-surface impact of the shoulder 43 of the eccentric 40 on the opposing shoulder 23 of the latch 20. The readiness position 20.4 can also already be present in the overstroke position of FIG. 4 due to the locking catch 27.

LIST OF REFERENCE NUMBERS

10 closing part, U-shaped closing bow
11 leg of 10 that engages 15
12 lock, lock housing
13 recess in 15 for 11
14 axis of rotation of 15
15 catch
15.1 main lock-in position of 15 (FIG. 1)
15.2 intermediate position of 15 (FIG. 2)
15.3 fully open position of 15 (FIGS. 3, 4, 5)
16 prelocking stop notch in 15
17 main stop notch in 15
18 stop on 12 for 22
19 arrow of the spring loading of 15
20 latch
20.1 locked position of 20 (FIG. 1)
20.2 intermediate position of 20 during lifting (FIG. 2)
20.3 fully lifted position of 20 (FIG. 3)
20.4 readiness position of 20 (FIGS. 4, 5)
21 first arm of 20, actuating arm (FIG. 8)
22 actuating surface on 21 for 40 (FIG. 8)
23 opposing shoulder on 23 for 43 (FIG. 8)
24 second arm of 20, blocking arm (FIG. 8)
25 opposing impact surface on 24 for 45 (FIG. 8)
26 axis of rotation of 20 (FIG. 8)
27 locking catch on 20 (FIG. 8)
28 third arm of 20, supporting arm (FIG. 8)
29 force arrow of the spring loading of 20 (FIG. 1)
30 motorized opening aid
31 motor of 30
32 first gear part, worm (FIG. 1)
33 second gear part, worm gear (FIG. 1)
34 motional arrow for 16 (FIG. 2)
35 arrow of the partial movement of 10 (FIG. 2)
36 peripheral flange on 46 (FIG. 7)
37 gap between 25, 45 (FIG. 5)
38 slot in 47 (FIG. 7)
39 disk remnant at 38 (FIG. 7)
40 eccentric of 30 (FIG. 7)
40.1 initial position of 40 (FIGS. 1, 5)
40.2 first intermediate position of 40 (FIG. 2)
40.3 third intermediate position of 40 (FIG. 3)
40.4 overstroke position of 40 with blocking (FIG. 4)
41 main segment of 40 (FIG. 7)
42 end segment of 40 (FIG. 7)
43 end-face shoulder of 42 (FIG. 7)
44 eccentric axis of 40 and 33 (FIG. 7)
45 impact surface at the beginning of 41 (FIG. 7)
46 eccentric curve of 40 (FIG. 7)
47 disk material of 40 (FIG. 7)
48 spring arm formed by 42 (FIG. 7)
49 free end face of 39 (FIG. 7)
50 trunk lid (FIG. 1)
51 plane of 21 (FIG. 6)
52 arrow of radial spring loading of 42 or 48 (FIG. 7)
53 distance between 23, 24, gap (FIG. 4)
54 plane of 24 (FIG. 6)
55 dot-dash arrow of the closing movement (FIG. 5)
56 possible bending of 46 at 42 or 48 (FIG. 7)
57 supporting catch on 20 (FIG. 1)
58 plane of 28 (FIG. 6)
59 arrow of the bending of 48 or 42 (FIG. 7)
60 automobile body (FIG. 1)
61 smallest radius of 41 (FIG. 7)
62 intermediate radius of 46 (FIG. 7)
63 maximum end radius of 42, 48 (FIG. 7)
64 prevented reverse rotation of 40 (FIG. 5)

The invention claimed is:

1. A lock mechanism with a moving part of a motor vehicle, such as a hinged lid (40) or door, and a stationary part (60) of the motor vehicle, consisting of a lock (12) on one part (50) of the motor vehicle and a closing part (10) on the stationary part (60), where the lock (12) comprises a rotatably supported catch (15), a rotatably supported latch (20) with an actuating arm (21), and a motorized opening aid (30), the catch (15) has a recess (13) for the closing part (10) and at least one stop notch (16, 17) for engaging the latch (20), the catch (15) and the latch (20) are spring loaded (19, 29) towards each other, and the opening aid (30) has a driven eccentric (40), whose eccentric curve (46) cooperates with a lateral actuating surface (22) on the actuating arm (21) in order to move the latch (20) by means of a motor out of its locked position (20.1) in the catch stop notch (17) and into a lifted position (20.3), in which the catch (15) is released, wherein the eccentric (40) has two segments (41, 42) of differing relative elasticity, the segments including an inelastic main segment (41) in a region of smaller radii (61, 62) of an eccentric curve (46) of the eccentric (40), the main segment beginning with an impact surface (45), and an elastically yielding (59) end segment (42) in a region of larger radii (62, 63) of the eccentric curve (46), the end segment (42) ending with an eccentric shoulder (43) at a maximum end radius (63), wherein the latch (20) has an opposing impact surface (25) which, in a final phase of the driving of the opening aid (30) strikes the impact surface (45) of the main segment (41) and stops further motorized rotation of the eccentric (40), wherein during rotation of the eccentric (40) the latch (20) strikes a stationary stop (18) in the lock (12), which stop (18) defines a fully lifted position (20.3) of the latch (20), whereby the lateral actuating surface (22) of the actuating arm (21) radially limits a free space for the eccentric curve (46), wherein during rotation of the eccentric (40) the main segment (41) with the small radii (61,62) passes through, but not the end segment (42) with the larger radii (62, 63) which results in the actuating surface (22) bending (56) the eccentric until the eccentric shoulder (43) snaps behind an opposing shoulder (23) on an end of the actuating arm (21), and after snapping in, the eccentric shoulder (43) and the opposing shoulder (23) on the actuating arm (21) prevent a reverse rotation (64) of the eccentric (40).

2. A lock mechanism in accordance with claim 1, wherein the actuating arm (21) of the latch (20) is elastically yielding.

3. A lock mechanism in accordance with claim 2, wherein the eccentric curve (46) of the main segment (41) begins at the impact surface (45).

4. A lock mechanism in accordance with claim 2, wherein the impact surface (45) runs approximately perpendicularly to the eccentric curve (46).

5. A lock mechanism in accordance with claim 2, wherein the latch (20) has a blocking arm (24)

where the opposing impact surface (25) is formed by the free end face of the blocking arm (24).

6. A lock mechanism in accordance with claim 1, wherein the end segment (42) of the eccentric (40) is designed as a spring arm (48)

where the outer lateral surface of the spring arm (48) forms an end section of the eccentric curve (46)

and where the spring arm (48) is elastically flexible (59) relative to the preceding main segment (41) of the eccentric (40).

7. A lock mechanism in accordance with claim 6, wherein the spring arm (48) is formed by a slot (38) in the disk material (47) of the eccentric (40)

where the slot (38) is set back from the controlling eccentric curve (46) towards the eccentric axis (44)

and where the slot (38) weakens the disk material (47) in the end segment (42) to such an extent that the remaining disk remnant (39) is radially flexible (59) and therefore forms the spring arm (48).

8. A lock mechanism in accordance with claim 6, wherein the shoulder (43) of the eccentric (40) is formed by the free end face (49) of the spring arm (48).

9. A lock mechanism in accordance with claim 1, wherein the opposing shoulder (23) of the latch (20) is formed by the free end face of the actuating arm (21), whose lateral actuating surface (22) interacts with the eccentric curve (46).

10. A lock mechanism in accordance with claim 1, wherein the main segment (41) of the eccentric (40) has an essentially dimensionally stable design.

11. A lock mechanism in accordance with claim 1, wherein, in addition to the actuating arm (21) and the blocking arm (24), the latch (20) has a supporting arm (28)

where the supporting arm (28) is supported on the stationary stop (18) in the lock (12) when the latch (20) is in its fully lifted position (20.3).

12. A lock mechanism in accordance with claim 11, wherein the actuating arm (21), the blocking arm (24), and the supporting arm (28) of the latch (20) are arranged at least partly in different planes (51, 54, 58) from one another and/or have arm lengths that are different from one another.

* * * * *